US006739922B2

(12) United States Patent
Matsuda

(10) Patent No.: US 6,739,922 B2
(45) Date of Patent: May 25, 2004

(54) PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/341,755

(22) Filed: Jan. 13, 2003

(65) Prior Publication Data

US 2003/0134548 A1 Jul. 17, 2003

(30) Foreign Application Priority Data

Jan. 17, 2002 (JP) ..... 2002-008696

(51) Int. Cl.[7] ..... B63H 21/32
(52) U.S. Cl. ..... 440/89 E
(58) Field of Search ..... 181/235; 440/89 E, 440/89 R

(56) References Cited

U.S. PATENT DOCUMENTS 3,893,407 A * 7/1975 Hurst ..... 440/57

5,591,058 A * 1/1997 Schriever et al. ..... 440/89 R

* cited by examiner

*Primary Examiner*—Ed Swinehart
(74) *Attorney, Agent, or Firm*—Kolisch Hartwell, P.C.

(57) ABSTRACT

Disclosed is a personal watercraft capable of preventing an exhaust gas from contaminating a transom board in the vicinity of an exhaust outlet and of reducing an exhaust noise of the exhaust gas within a wide speed range. The personal watercraft having an engine disposed in a body thereof for driving a water jet pump comprises, an exhaust outlet 2D formed at a rear end of an exhaust passage Ep extending from an exhaust port of the engine E to a transom board Tm of the watercraft so as to open rearwardly; a flexible sheet member 3 disposed at the exhaust outlet and having a closing portion 3A capable of opening/closing the exhaust outlet by an exhaust pressure of the exhaust gas; and a short pipe 5P mounted to the outside of the transom board and extending rearwardly from the transom board Tm so as to surround the closing portion 3A of the sheet member 3, for introducing the exhaust gas rearwardly.

8 Claims, 10 Drawing Sheets

PERSONAL WATERCRAFT

BACKGROUND OF THE INVENTION

1. Field of the Invention

The present invention relates to a personal watercraft (PWC) which ejects water rearward and planes on a water surface as the resulting reaction. More particularly, the present invention relates to a structure of an exhaust outlet portion of an exhaust passage extending from an exhaust port of an engine to a transom board.

2. Description of the Related Art

In recent years, so-called jet-propulsion personal watercraft have been widely used in leisure, sport, rescue activities, and the like. The jet-propulsion personal watercraft is configured to have a water jet pump that pressurizes and accelerates water sucked from a water intake generally provided on a bottom of a hull and ejects it rearward from an outlet port. Thereby, the personal watercraft is propelled.

In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to the right or to the left.

In the jet-propulsion personal watercraft, an engine is disposed in an engine room such that a crankshaft extends along the longitudinal direction of the watercraft. The crankshaft projects rearwardly and its rear end is coupled to a pump shaft of the water jet pump, thereby driving the water jet pump.

An exhaust gas from the engine is introduced into a muffler and muffled therein, and the resulting exhaust gas is discharged outside the watercraft from an exhaust outlet that opens in a transom board at the rear end of the watercraft.

In the personal watercraft having the above configured exhaust outlet, the transom board or the like in the vicinity of the exhaust outlet is susceptible to contamination by the exhaust gas. Accordingly, the applicant disclosed an invention relating to an exhaust outlet of the watercraft, in which, by attaching an extending pipe bent obliquely downwardly at the rear end thereof to the rear end of the exhaust outlet, the contamination of the transom board by the exhaust gas is prevented and the exhaust noise is caused to contact the water surface to be reduced (see U.S. Pat. No. 6,206,741).

Although, in this structure, the exhaust noise is reduced while the watercraft is cruising at a high speed, the watercraft sometimes resonates with the water surface while cruising at a medium or low speed. With this structure, the exhaust noise is difficult to effectively reduce within a wide speed range.

SUMMARY OF THE INVENTION

The present invention addresses the above described conditions, and an object of the present invention is to provide a personal watercraft capable of preventing an exhaust gas discharged from an exhaust outlet that opens in a transom board from contaminating the transom board in the vicinity of the exhaust outlet and of reducing an exhaust noise of the exhaust gas within a wide speed range.

According to the present invention, there is provided a personal watercraft having an internal combustion engine disposed in a body thereof, for driving a water jet pump, comprising: a transom board; an exhaust outlet formed in the transom board at a rear end of an exhaust passage extending from an exhaust port of the engine to the transom board so as to open rearwardly; a flexible sheet member disposed at the exhaust outlet and having a closing portion capable of opening/closing the exhaust outlet by an exhaust pressure of an exhaust gas of the engine; and a short pipe mounted to an outside of the transom board and extending rearwardly from the transom board so as to surround the closing portion of the sheet member, for introducing the exhaust gas rearwardly.

With such a structure, the exhaust gas being discharged from the exhaust outlet formed in the transom board at the rear end of the exhaust passage extending to the transom board so as to open rearwardly is discharged outside the watercraft from a passage formed between the exhaust outlet and the sheet member by opening the closing portion of the sheet member provided in the exhaust outlet by deforming the closing portion of the flexible sheet member due to the pressure of the exhaust gas. In addition, the short pipe extending rearwardly from the transom board so as to surround the periphery of the closing portion, i.e., the short pipe surrounding the portion of the sheet member through which the exhaust gas flows and introduces the exhaust gas rearwardly, extends rearwardly from the transom board. Thereby, the exhaust gas is discharged outside the watercraft from the rear end of the short pipe located behind and apart from the transom board. As a result, the transom board is prevented from being contaminated by the exhaust gas. In addition, the exhaust noise is caused to contact the flexible sheet member and to be absorbed therein, so that the noise is reduced while the watercraft is cruising at a wide range of speeds, or is at rest on the water surface. Further, in the case where water from behind the watercraft splashes toward the exhaust outlet, the closing portion of the sheet member protects the exhaust outlet by closing the same, thus preventing water ingress from the exhaust outlet into the engine.

Preferably, the personal watercraft may further comprise a press member for mounting the sheet member and the short pipe to the transom board, and the press member has a mounting portion for mounting the sheet member and the short pipe to the transom board from behind the body.

Preferably, the short pipe may be formed integrally with the press member. In this structure, the number of parts is reduced, and the seal between the short pipe and the press member and rigidity of these members are improved.

Preferably, the sheet member may have a closing portion larger than the exhaust outlet and capable of closing the exhaust outlet, a peripheral portion provided around the closing portion so as to be separated from the closing portion, and a connecting portion partially connecting the closing portion to the peripheral portion, and the short pipe may have a vent passage sized to permit the closing portion to swing rearwardly around the connecting portion.

Preferably, the mounting portion of the press member may be mounted to the transom board to mount the peripheral portion of the flexible sheet member.

Preferably, the connecting portion of the sheet member may be located at an upper portion of the closing portion. In this structure, when the exhaust gas is discharged, the closing portion is deformed around the upper portion by its exhaust pressure so as to swing around the upper portion away from the exhaust outlet, so that an exhaust passage is created. In this structure, since the closing portion of the sheet member is suspended from the upper portion, a reliable structure is achieved.

Preferably, the closing portion may be separated in an incomplete-circle shape by a slit from the peripheral portion of the sheet member except the connecting portion.

Preferably, the closing portion may be separated by a slit in a U-shape from the peripheral portion of the sheet member, except the connecting portion, the closing portion being substantially U-shaped with a lower portion formed by a semi-circular line and an upper portion formed by straight lines extending from the semi-circular line. In this structure, the length of the connecting portion can be set larger and durability can be thereby increased.

Preferably, the sheet member may be made of rubber. The sheet made of rubber has flexibility and durability.

The above and further objects and features of the invention will be more fully be apparent from the following detailed description with accompanying drawings.

DETAILED DESCRIPTION OF THE PREFERRED EMBODIMENTS

Hereinafter, a personal watercraft according to an embodiment of the present invention will be described with reference to the accompanying drawings.

Figure 9:
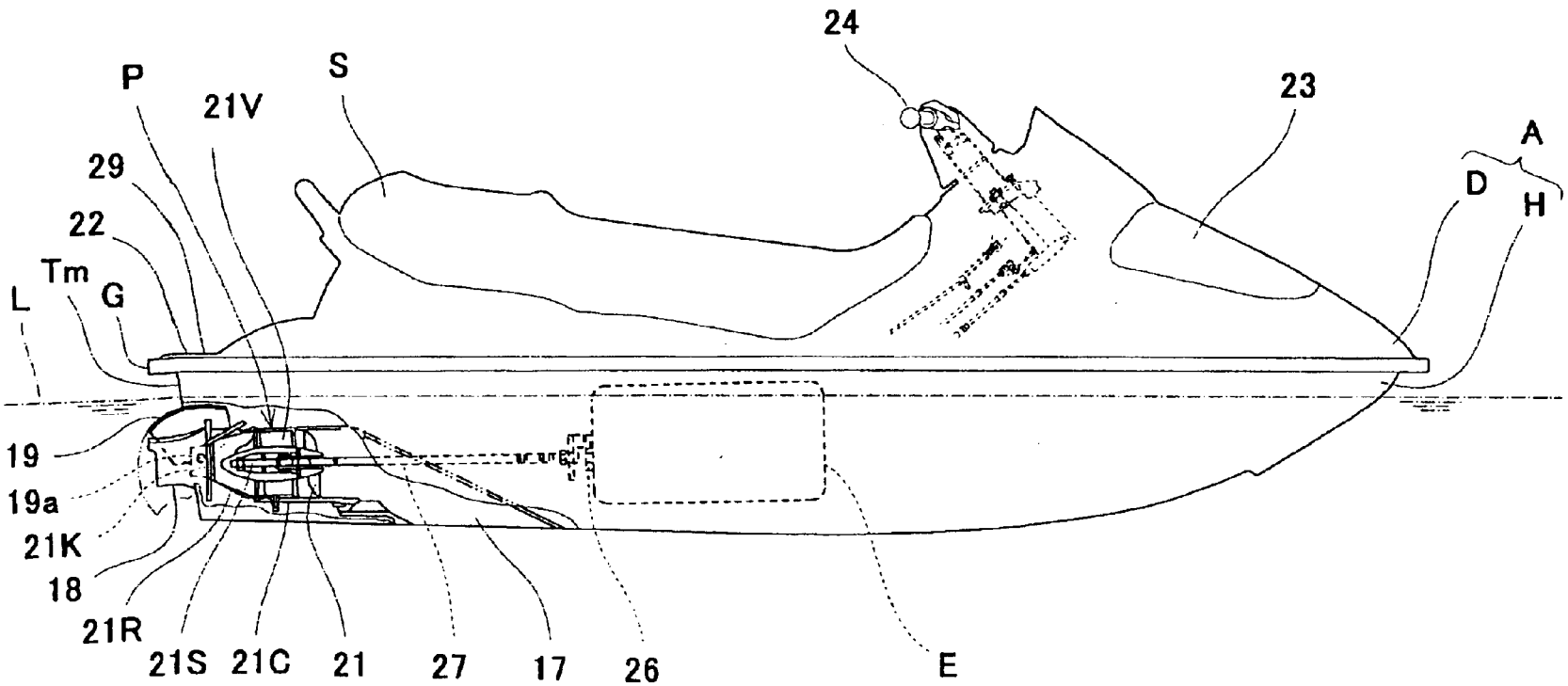
FIG. 9 is a side view showing the personal watercraft according to the embodiment of the present invention.
Figure 10:
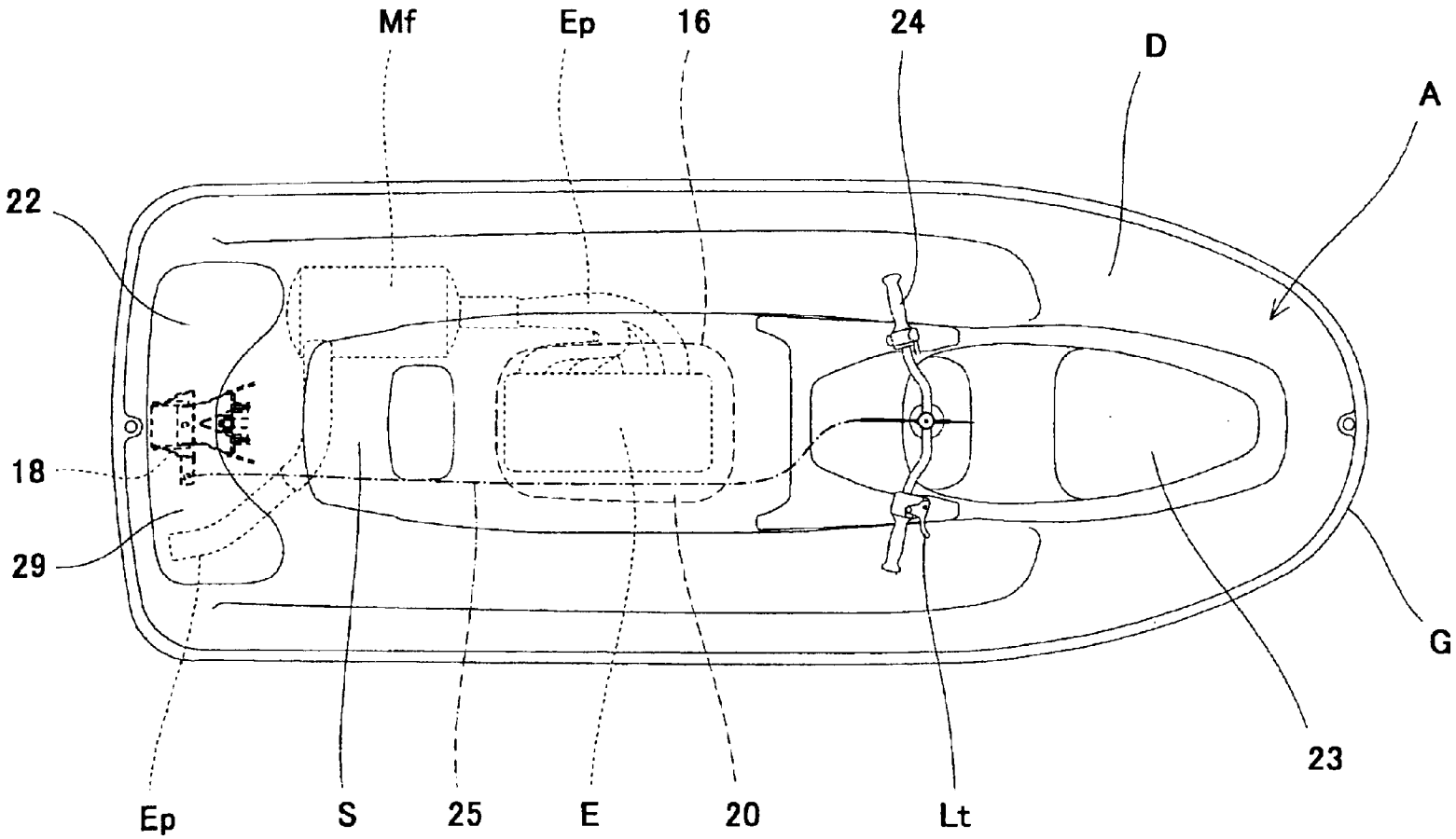
FIG. 10 is a plan view showing the personal watercraft in FIG. 9.

Referring now to FIGS. 9 and 10, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 10, an opening 16, which has a substantially rectangular shape seen from above, is formed at a relatively rear section of the deck D such that its extends in the longitudinal direction of the body A, and a riding seat S is mounted above the opening 16 such that it covers the opening 16 from above as shown in FIGS. 9 and 10.

An engine E is contained in a chamber 20 surrounded by the hull H and the deck D below the seat S and having a convex-shape in a cross-section of the body. The engine E includes multiple cylinders (e.g., four cylinders) and is a fuel-injection type. As shown in FIG. 9, a crankshaft 26 of the engine E is mounted along the longitudinal direction of the body A. An output end of the crankshaft 26 is rotatably coupled integrally with a pump shaft 21S of a water jet pump P through a propeller shaft 27. An impeller 21 is mounted on the output shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump p through a water intake passage 28. The water jet pump P pressurizes and accelerates the water. The pressurized and accelerated water is discharged through a pump nozzle 21R having a cross-sectional area of flow gradually reduced rearward, and from an outlet portion 21K provided on the rear end of the pump nozzle 21R, thereby obtaining the propulsion force.

In FIG. 9, reference numeral 21V denotes fairing vanes for fairing water flow behind the impeller 21. As shown in FIGS. 9 and 10, reference numeral 24 denotes a bar-type steering handle as a steering operation handle. By operating the steering handle 24 to the right or to the left, the steering nozzle 28 provided behind the pump nozzle 21R swings to the right or to the left through a wire cable 25. The watercraft can be turned to any desired direction while the water jet pump P is generating the propulsion force. A throttle lever Lt is mounted on the right end portion of the handle 24.

As shown in FIG. 9, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward and, as the resulting reaction, the personal watercraft moves rearward.

In FIGS. 9 and 10, reference numeral 22 denotes a rear deck. The rear deck 22 is provided with an operable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

Figure 3:
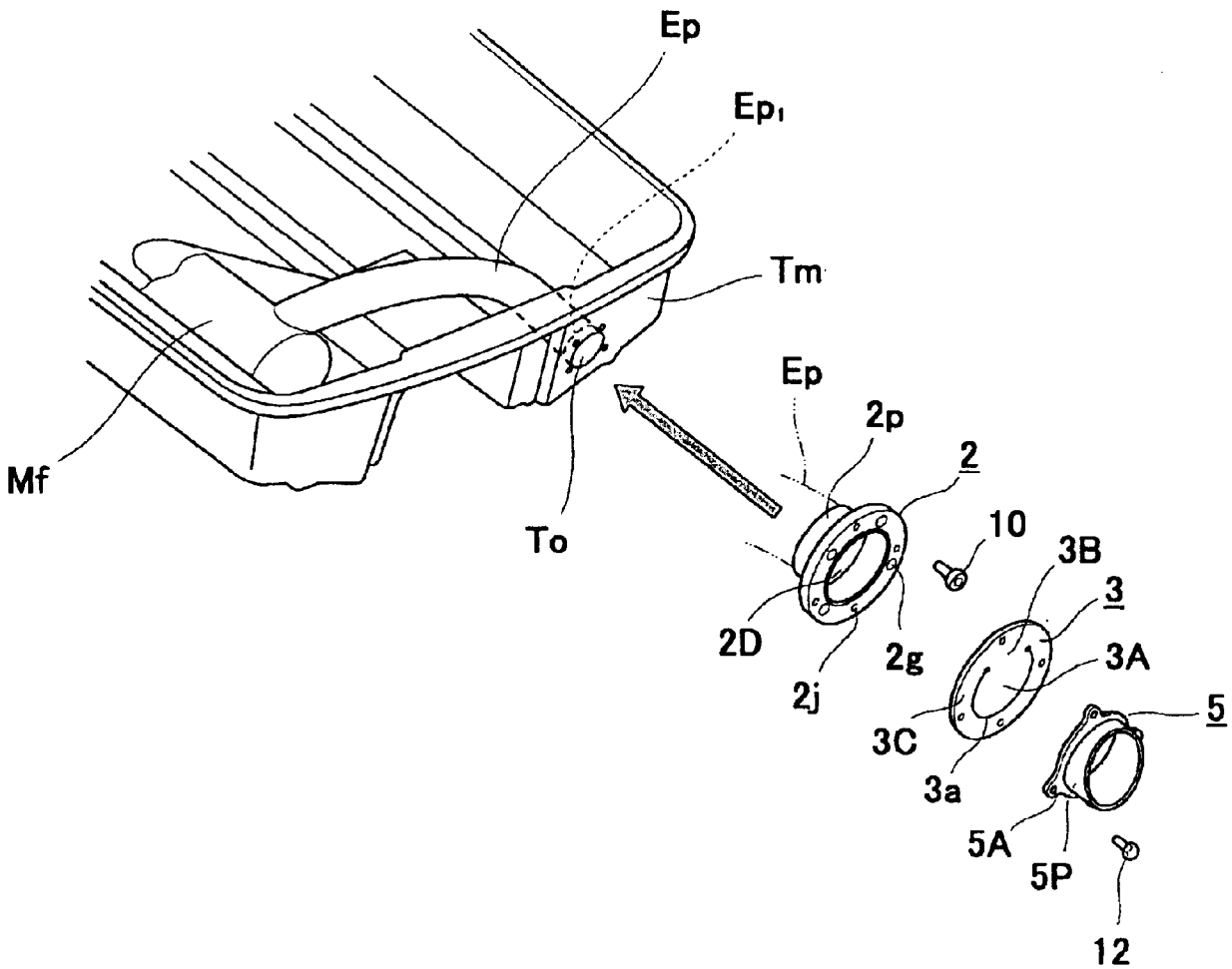
FIG. 3 is an exploded perspective view showing placement of an exhaust passage in a hull portion at a rear portion of the personal watercraft provided with the exhaust outlet portion in FIGS. 1 and 2, and the structure of the exhaust outlet portion.

In the personal watercraft according to an embodiment of the present invention, as shown in FIG. 10, an exhaust pipe (exhaust passage) Ep having a muffler Mf extends from exhaust ports of the engine E to a transom board Tm (see FIG. 9). As shown in FIG. 3, a rear end Ep1 of the exhaust pipe Ep opens outside through an opening To formed in the transom board Tm.

As shown in FIG. 3, a base member 2 is attached to the rear end Ep1 of the exhaust pipe Ep in such a manner that the base member 2 is inserted into the opening To from outside the watercraft. As shown in an enlarged cross-sectional view in FIG. 2A and in a front view of the base member in FIG. 3, the base member 2 has a cylindrical pipe portion 2*p* having an opening as an exhaust outlet 2D at the center thereof and extending inside the body. The pipe portion 2*p* of the base member 2 is inserted into the inside of the watercraft. The outer diameter of the pipe portion 2P substantially conforms to the diameter of the opening To. To be precise, the outer diameter of the pipe portion 2*p* is slightly smaller than the diameter of the opening To. In a portion of the base member 2, which is on the outer side of the pipe portion 2*p*, a flange 2*f* having an outer diameter larger than the diameter of the opening To is provided.

Figure 2A:
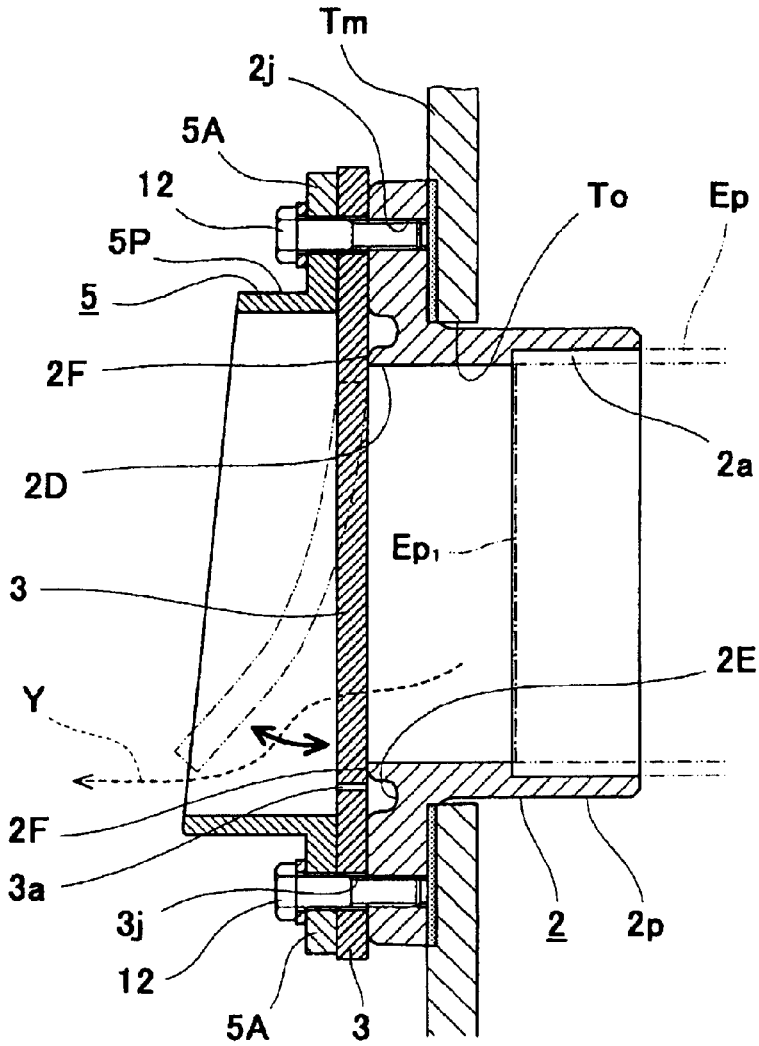
FIG. 2A is a view taken in the direction of arrows along line IIa—IIa in FIG. 1, showing a structure of the exhaust outlet portion in FIG. 1.

As shown in FIG. 2A, an enlarged portion 2*a* having a diameter larger than that of the exhaust outlet 2D is formed on an inner periphery of a tip end (an end on the inner side of the body) of the pipe portion 2*p* of the base member 2. The rear end Ep1 of the exhaust pipe Ep (indicated by a dashed line in FIG. 2) is connected to the enlarged portion 2*a*.

Figure 2B:
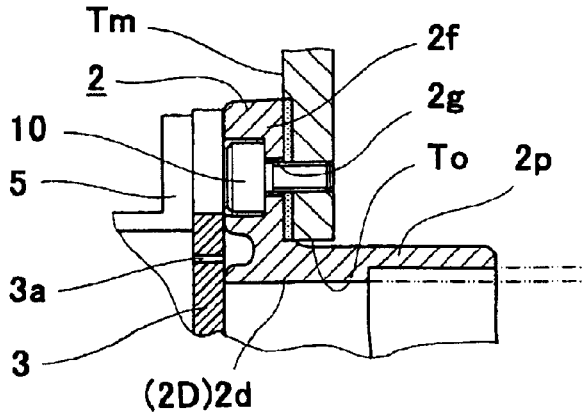
FIG. 2B is a partial cross-sectional view taken in the direction of arrows along line IIb—IIb in FIG. 1, showing a structure of a mounting portion of the exhaust outlet portion in FIG. 1.

As shown in FIG. 2B, the base member 2 is mounted to the transom board Tm through mounting holes 2*g* formed on the periphery of the base member 2 by means of hexagon socket head cap screws 10. In this embodiment, the base member 2 is configured such that the pipe portion 2*p* to be inserted into the opening To protrudes from one side of the circular flange portion 2*f* provided with an opening 2*d* as the exhaust outlet 2D at the center thereof.

Figure 4:
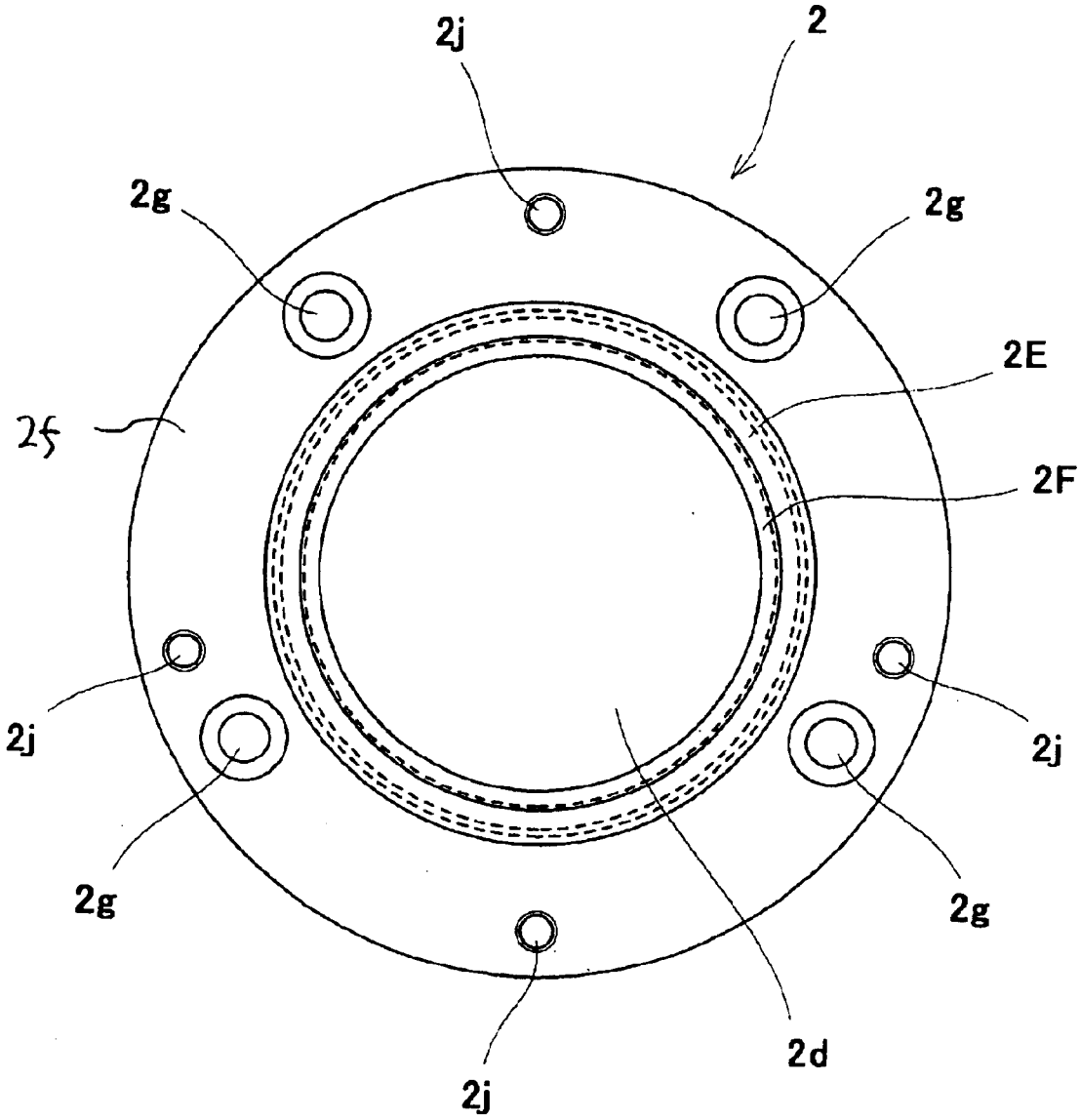
FIG. 4 is a front view of a base member in FIGS. 1–3.

As shown in FIGS. 2A and 4, a circular groove 2E is formed on an outer face of the flange portion 2*f* of the base member 2 so as to surround the exhaust outlet 2D from its outer periphery and be concentric with the exhaust outlet 2D. However, the groove 2E is not necessarily concentric with the exhaust outlet 2D. Between the circular groove 2E and the exhaust outlet 2D, a support portion 2F which is lip-shaped in cross-section and ring-shaped in rear view is provided for supporting the periphery of a closing portion 3A of a seat member 3 from its rear surface side (inner side). As shown in FIG. 4, the base member 2 is provided with mounting holes 2*j* through which a press member 5 is mounted to the base member 2 between adjacent mounting holes 2*g* in the circumferential direction thereof. The mounting hole 2*j* is provided with a female screw on its inner periphery.

Figure 5:
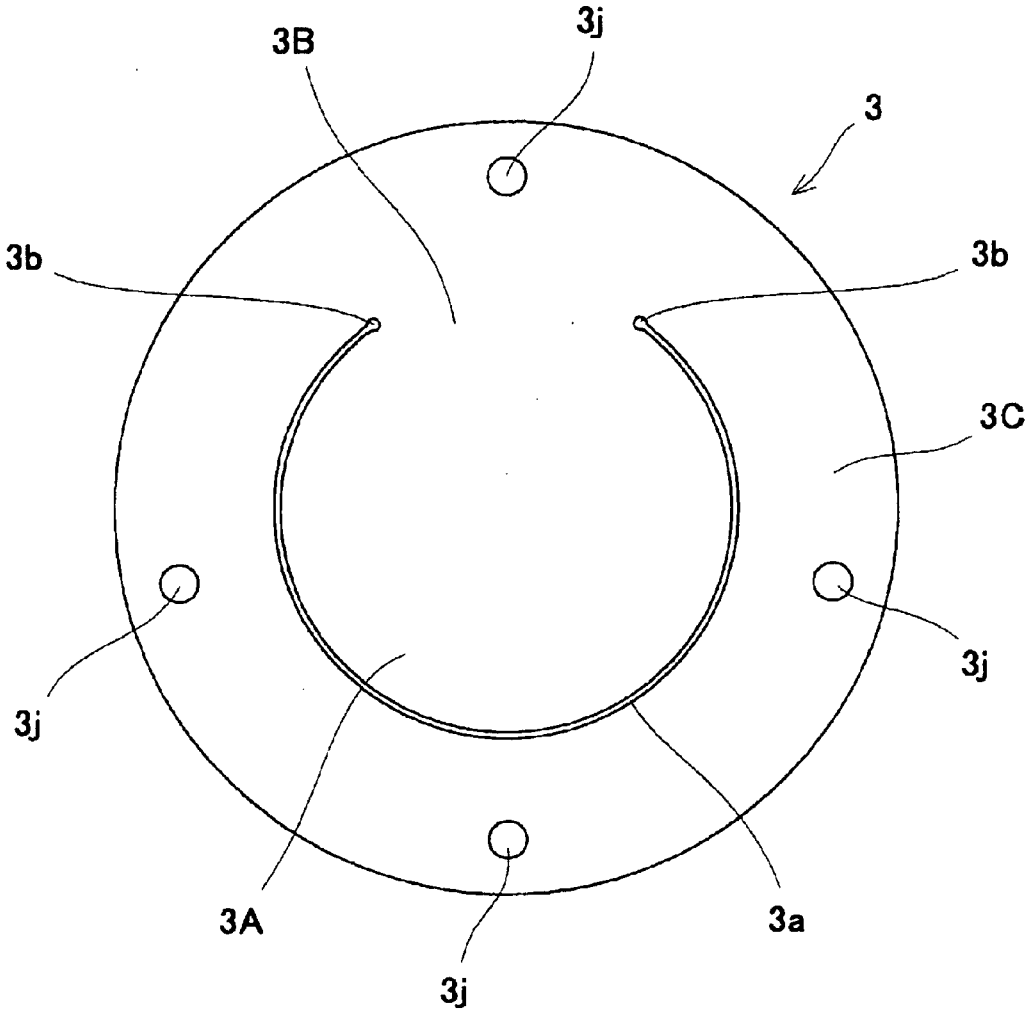
FIG. 5 is a front view of a sheet member in FIGS. 1–3.

Then, to the outer face of the flange portion 2*f* of the base member 2, the sheet member 3 which is made of a flexible sheet in a circular shape is attached (see FIG. 3). The flexible sheet member 3 has a slit 3*a* of an incomplete-circle shape except a connecting portion 3B (in this embodiment, an upper end portion). The slit 3*a* forms a closing portion 3A separated from a peripheral portion 3C except a connecting portion 3B. By the connecting portion 3B located on the upper side in FIG. 5, the closing portion 3A is connected to the peripheral portion 3C provided on the outer periphery of the flexible sheet member 3.

Figure 1:
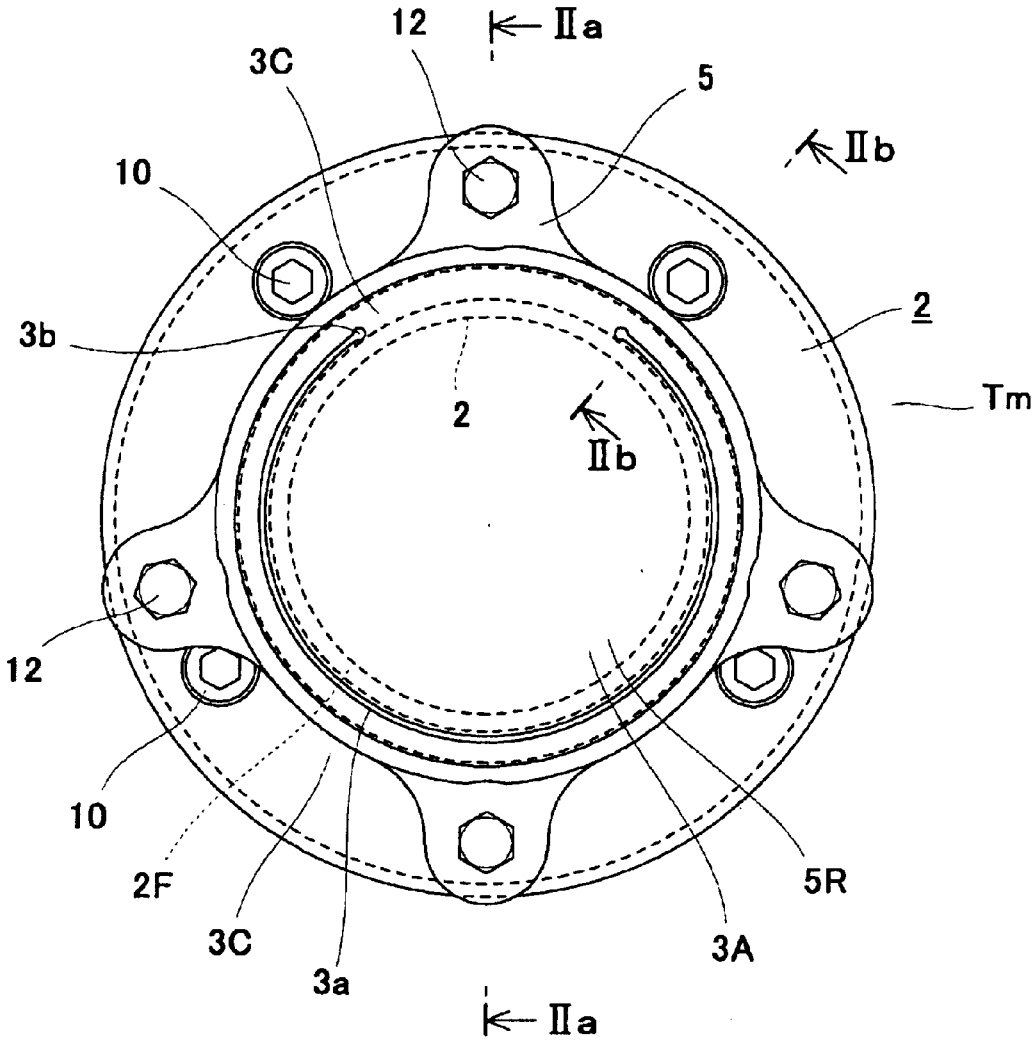
FIG. 1 is an enlarged rear view showing an exhaust outlet portion of a personal watercraft according to an embodiment of the present invention.

As shown in FIG. 1, the closing portion 3A is sized to be larger than the exhaust outlet 2D to close the exhaust outlet 2D. In other words, the outer periphery of the closing portion 3A is located radially outward of the outer periphery of the exhaust outlet 2D. In this embodiment, further, the outer periphery of the closing portion 3A is located radially outward of the outer diameter of the support portion 2F annularly formed on an outer peripheral region of the exhaust outlet 2D and, as described above, the closing portion 3A is in contact with and supported by the support portion 2F of the base member 2 from its rear face (inner side). At both ends of the slit 3*a* of the sheet member 3, stop holes 3*b* are formed to prevent the slit 3*a* from being broken along its extended line. Four penetrating holes 3*j* through which bolts 12 are inserted are formed at upper, lower, right and left positions on the peripheral portion 3C to coincide with the mounting holes 2*j* of the base member 2. And, the sheet member 3 is mounted to the base member 2 side with the press member 5 shown in FIG. 6.

Figure 6:
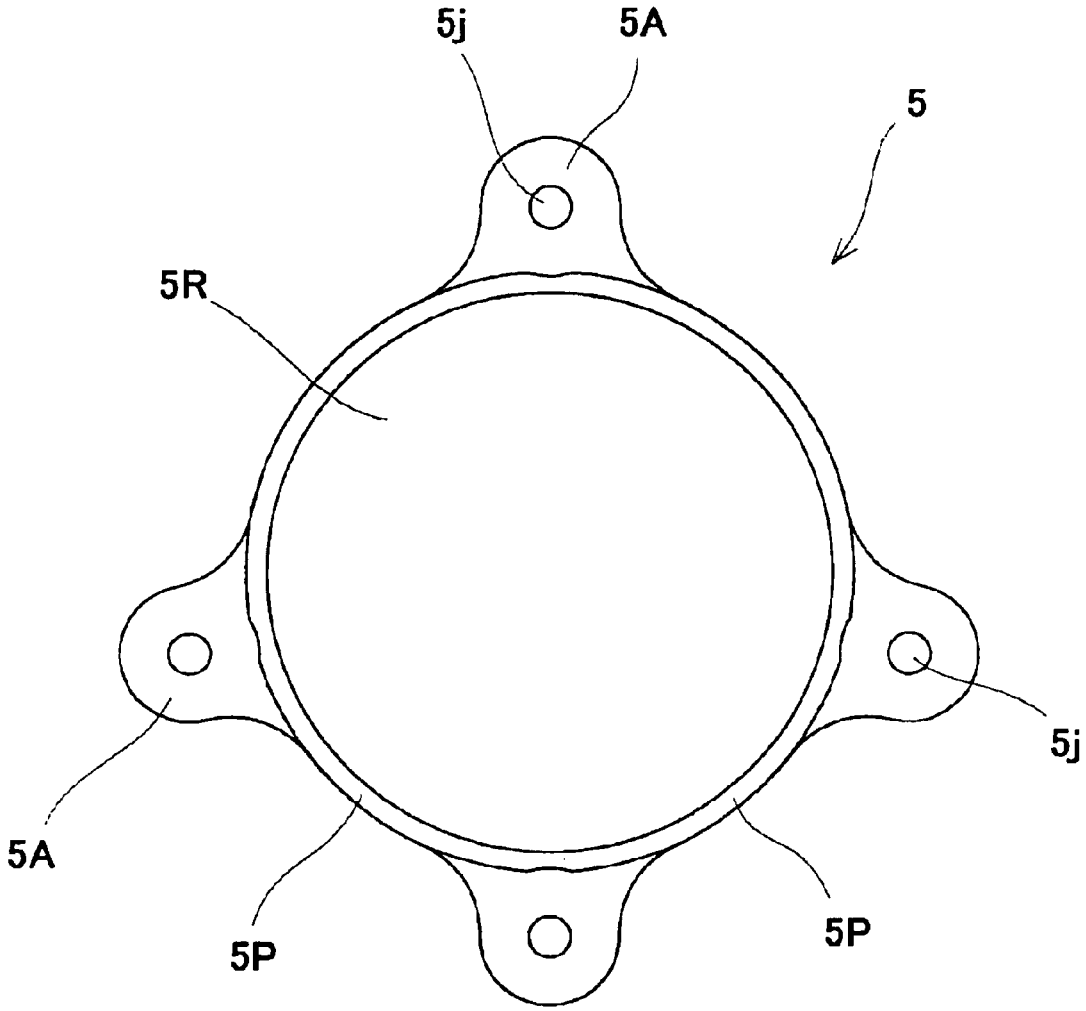
FIG. 6 is a front view of a press member in FIGS. 1–3.

As shown in FIG. 6, the press member 5 has outwardly protruding mounting portions 5A at plural positions (upper, lower, right, and left positions) on its outer peripheral portion. A short pipe 5P is formed integrally with the press member 5 to be located on near side in the depth direction in FIG. 6 (rear side in the state in which the press member 5 is mounted to the transom board Tm). Instead, the short pipe 5P may be independent of the press member 5. In this embodiment, as shown in FIG. 2A, the lower end portion of the short pipe 5*p* extends rearwardly to be longer than the upper portion thereof so as to be adapted to an operation region of the closing portion 3A of the sheet member 3. The press member 5 is mounted to the base member 2 by means of the mounting bolts 12 inserted through the mounting holes 5*j* formed in the mounting portion 5A with the seat member 3 retained between them (see FIGS. 2 and 3). Such mounting is accomplished by screwing the mounting bolts 12 into the mounting holes 2*j* of the base member 2. The short pipe 5P has an inner space as a vent hole 5R to permit the closing portion 3A of the sheet member 3 to swing rearwardly around the connecting portion 3B. Therefore, the vent hole 5R is larger than the exhaust outlet 2D of the base member 2.

Figure 7:
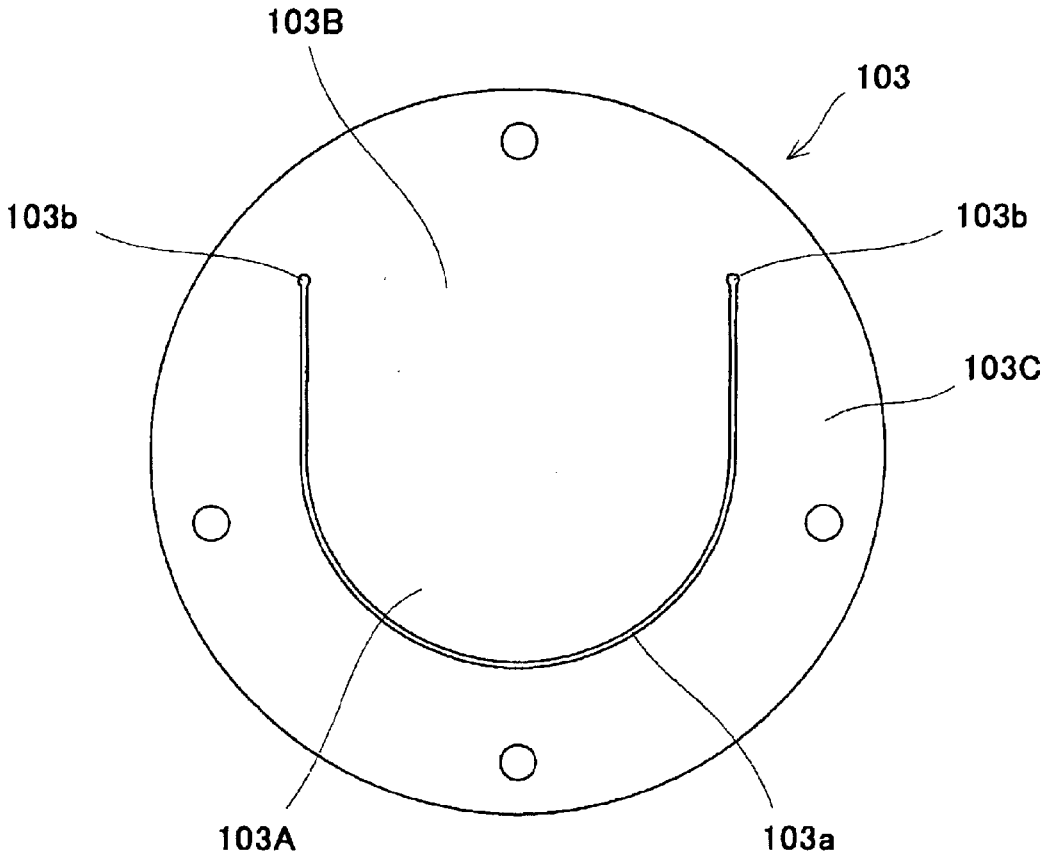
FIG. 7 is a front view showing a structure of a sheet member according to another embodiment.

Instead of the sheet member 3 in FIG. 3, a sheet member 103 having a U-shaped slit 103*a* shown in FIG. 7 may be used. A closing portion 103A of the sheet member 103 is substantially U-shaped such that the closing portion 103A is comprised of a lower portion formed by a semi-circular line and an upper portion formed by straight lines extending upwardly from the semi-circular line. In this structure, a connecting portion 103B connecting the closing portion 103A to its outer peripheral portion 103C is made longer. That is, the length of portion without the slit 103*a* between stop holes 103*b* formed at both ends of the slit 103*a* can be increased. In the sheet member 103 so structured, since the length of the connecting portion 103B can be increased, the sheet member 103 becomes durable against fatigue break caused by the swing of the closing portion 103A due to flow of the exhaust gas.

Figure 8:
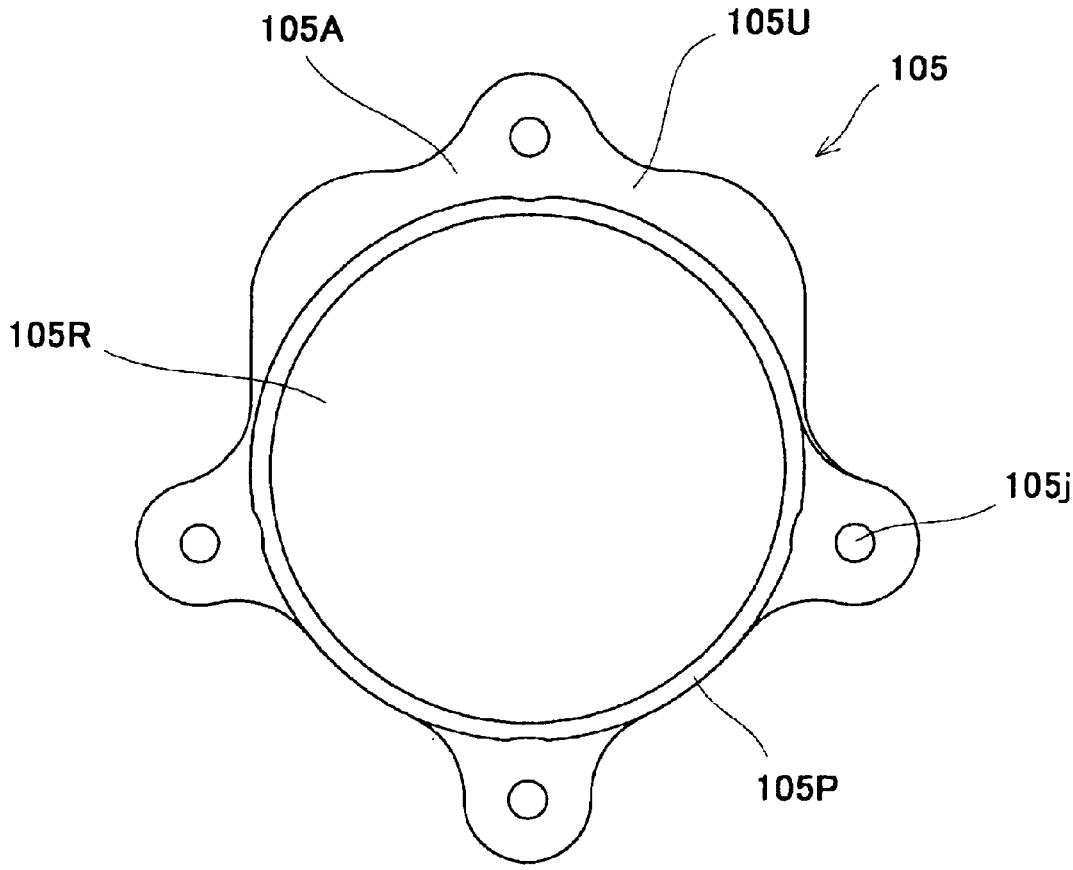
FIG. 8 is a front view showing a structure of a press member according to another embodiment, which is used in the sheet member in FIG. 7.

A press member 105 for mounting the sheet member 103 is configured such that an upper portion 105U thereof has a mounting portion 105A protruding greatly in the vertical and horizontal directions so as to conform in shape to the slit 103*a*. With this structure, the stop holes 103*b* of the slit 103*a* are pressed toward the base member 2 by the mounting portions 105A of the upper portion 105U. The other structure is identical to that of the press member 5 (see FIG. 6), and the corresponding components in FIG. 8 are identified by the corresponding reference numerals plus 100.

The personal watercraft provided with the exhaust outlet having the above structure functions as follows. As shown in FIG. 2A, when the exhaust gas is discharged from the exhaust pipe Ep outside the watercraft, the flexible sheet member 3 in contact with the support portion 2F of the base member 2 (or 102) comes off the support portion 2F by the exhaust pressure of the exhaust gas as indicated by a two-dot chain line in FIG. 2A, thereby causing the exhaust gas to be discharged to the ambient side as indicated by a broken line Y in FIG. 2A. In this case, according to the exhaust pressure, i.e., the engine speed of the engine E, the swing degree of the sheet member 3 to the left in FIG. 2A varies.

The exhaust gas so discharged is smoothly introduced rearwardly from the transom board Tm through the short pipe 5P of the press member 5 (or 105) extending rearwardly. Therefore, the exhaust gas is discharged rearwardly (outside the watercraft) without contaminating the transom board Tm of the personal watercraft.

The exhaust noise of the exhaust gas contacts the flexible sheet member 3 and is absorbed therein. Also, the exhaust noise is not emitted directly from the exhaust outlet outside the watercraft and is not diffused around the watercraft because the exhaust outlet is surrounded by the press member 5P. As a result, the exhaust noise is reduced.

To obtain desirable functions and effects with the above structure, the flexibility of the sheet member 3 (or 103) is suitably selected according to the output of the engine. The flexibility can be varied by varying the thickness of the sheet member 3 or the material of the sheet member 3. Also, the flexibility can be varied by providing a groove with a bottom or a hole with a bottom in the connecting portion 3B of the sheet member 3. The provision of the groove with a bottom or the hole with a bottom in the sheet member 3 produces a higher noise-absorbing effect in addition to the variation in the flexibility. The sheet members 3, 103 have similar function and effects, but the sheet member 103 is superior in durability to the sheet member 3.

Preferably, the sheet members 3, 103 are made of waterproof rubber. For example, NBR sheet may be used. Alternatively, the sheet members 3, 103 may be made of soft plastic, or any other materials having flexibility and durability.

The base member 2 may be made of hard plastic, metal such as stainless steel or aluminum, or hard rubber.

The press member 5 may be made of hard plastic, metal such as stainless steel or aluminum, or hard rubber.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft having an internal combustion engine disposed in a body thereof, for driving a water jet pump, comprising:

a transom board;

an exhaust outlet formed in the transom board at a rear end of an exhaust passage extending from an exhaust port of the engine to the transom board so as to open rearwardly;

a flexible sheet member disposed at the exhaust outlet and having a closing portion capable of opening/closing the exhaust outlet by an exhaust pressure of an exhaust gas of the engine;

a short pipe mounted to an outside of the transom board and extending rearwardly from the transom board so as to surround the closing portion of the sheet member, for introducing the exhaust gas rearwardly; and a press member for mounting the sheet member and the short pipe to the transom board, wherein the press member has a mounting portion for mounting the sheet member and the short pipe to the transom board from behind the body.

2. The personal watercraft according to claim 1, wherein the short pipe is formed integrally with the press member.

3. A personal watercraft having an internal combustion engine disposed in a body thereof, for driving a water jet pump, comprising:

a transom board;

an exhaust outlet formed in the transom board at a rear end of an exhaust passage extending from an exhaust port of the engine to the transom board so as to open rearwardly;

a flexible sheet member disposed at the exhaust outlet and having a closing portion capable of opening/closing the exhaust outlet by an exhaust pressure of an exhaust gas of the engine; and a short pipe mounted to an outside of the transom board and extending rearwardly from the transom board so as to surround the closing portion of the sheet member, for introducing the exhaust gas rearwardly;

wherein the sheet member has a closing portion larger than the exhaust outlet and capable of closing the exhaust outlet, a peripheral portion provided around the closing portion so as to be separated from the closing portion, and a connecting portion partially connecting the closing portion to the peripheral portion, and the short pipe has a vent passage sized to permit the closing portion to swing rearwardly around the connecting portion.

4. The personal watercraft according to claim 3, further comprising a press member for mounting the sheet member and the short pipe to the transom board from behind the body, wherein a mounting portion of the press member is mounted to the transom board to mount the peripheral portion of the flexible sheet member.

5. The personal watercraft according to claim 3, wherein the connecting portion of the sheet member is located at an upper portion of the closing portion.

6. The personal watercraft according to claim 5, wherein the closing portion is separated in an incomplete-circle shape by a slit from the peripheral portion of the sheet member except the connecting portion.

7. The personal watercraft according to claim 5, wherein the closing portion is separated by a slit in a U-shape from the peripheral portion of the sheet member except the connecting portion, the closing portion being substantially U-shaped with a lower portion formed by a semi-circular line and an upper portion formed by straight lines extending from the semi-circular line.

8. The personal watercraft according to claim 3, wherein the sheet member is made of rubber.

* * * * *